US005624280A

United States Patent [19]

Kato

[11] Patent Number: 5,624,280

[45] Date of Patent: Apr. 29, 1997

[54] BRANCH JOINT BOX ACCOMMODATING BUS BARS AND BUS BAR BLANK

[75] Inventor: Shinshu Kato, Yokkaichi, Japan

[73] Assignee: Sumitomo Wiring Systems, Ltd., Yokkaichi, Japan

[21] Appl. No.: 327,785

[22] Filed: Oct. 20, 1994

[30] Foreign Application Priority Data

Nov. 8, 1993 [JP] Japan ..... 5-278446

[51] Int. Cl.[6] ..... H01R 11/09

[52] U.S. Cl. ..... 439/724; 439/212

[58] Field of Search ..... 439/724, 212, 439/213, 701, 709, 712, 76.2

[56] References Cited

U.S. PATENT DOCUMENTS

| | | | |
|---|---|---|---|
| 5,160,274 | 11/1992 | Ozaki et al. . | |
| 5,207,591 | 5/1993 | Ozaki et al. . | |
| 5,295,847 | 3/1994 | Ozaki et al. . | |
| 5,295,858 | 3/1994 | Kasai et al. . | |
| 5,322,445 | 6/1994 | Ozaki | 439/212 |
| 5,490,794 | 2/1996 | Kobayashi et al. | 439/212 |

*Primary Examiner*—Khiem Nguyen
*Assistant Examiner*—Yong Kim
*Attorney, Agent, or Firm*—Greenblum & Bernstein P.L.C.

[57] ABSTRACT

A branch joint box includes upper and lower casings of an identical shape which form a casing assembly by overturning one of the upper and lower casings. First connector portions and second connector portions are arranged in a plurality of rows and having first terminal holes and second terminal holes, respectively. Bus bars each have a coupling portion accommodated in the casing assembly and first and second terminal portions extend from opposite sides of the coupling portion, respectively, and project out of the first and second terminal holes, respectively. The upper and lower casings have first and second locking portions engageable with each other and are disposed at one side of the first and second connector portions, respectively. Each of the upper and lower casings has a protrusion formed on one outer side face adjacent to the other side of each of the first and second connector portions such that a pitch from a distal end of the protrusion to a corresponding outermost one of the first and second terminal holes coincides with a pitch from the other outer side face of each of the upper and lower casings to a corresponding outermost one of the first and second terminal holes such that the first and second terminal holes are disposed symmetrically in alignment with each other.

2 Claims, 8 Drawing Sheets

BRANCH JOINT BOX ACCOMMODATING BUS BARS AND BUS BAR BLANK

BACKGROUND OF THE INVENTION

The present invention generally relates to a branch joint box in which bus bars are accommodated and a bus bar blank and more particularly, to a branch joint box in which coupling portions of the bus bars are accommodated in a casing assembly formed by upper and lower casings of an identical shape by overturning one of the upper and lower casings upside down and upper and lower terminal portions extending from opposite sides of the coupling portions are projected out of terminal holes of connector portions of the upper and lower casings, respectively such that the upper and lower terminal portions extend symmetrically in alignment with each other and a bus bar blank from which a plurality of bus bar sets each having a plurality of the bus bars can be taken efficiently.

A number of bus bars are accommodated in a branch joint box provided in the course of wiring harnesses for a motor vehicle so as to perform connection and branching of an electric circuit and terminals provided on the bus bars are projected out of terminal holes of a connector portion of a casing assembly of the branch joint box so as to be connected to terminals of a mating connector which is connected to the connector portion of the casing.

In the known branch joint box of this kind, a casing assembly 3 of the branch joint box is formed by coupling upper and lower casings 1 and 2 of identical shape as shown in FIGS. 1 to 3. A number of bus bars 4 are accommodated in the casing assembly 3 in parallel and terminal portions **4*b* and 4*c* extending from a coupling portion 4*a* of each bus bar 4 upwardly and downwardly are, respectively, projected out of terminal holes 5*a* and 6*a* of connector portions 5 and 6 disposed at upper and lower portions of the casing assembly 3. In order to lock the upper and lower casings 1 and 2 to each other, male and female locks 7 and 8 are provided on each of opposite side faces of each of the upper and lower casings 1 and 2 such that the male and female locks 7 and 8 on one of the opposite faces of each of the upper and lower casings 1 and 2 are, respectively, disposed diagonally relative to those on the other of the opposite faces of each of the upper and lower casings 1 and 2 as shown in FIG. 2. By overturning one of the upper and lower casings 1 and 2 upside down, the upper and lower casings 1 and 2 are coupled with each other. The upper and lower casings 1 and 2 are, respectively, partitioned by central partition walls 1*a* and 2*a*. The connector portions 5 and 6 are laterally arranged in a plurality of rows, for example, four rows shown in FIG. 1 at the upper and lower portions of the casing assembly 3, respectively. A hollow in the casing assembly 3 is used as a space 9 for accommodating the bus bars 4**.

Each of the connector portions 5 has the terminal holes **5*a* of two rows and each of the connector portions 6 has the terminal holes 6*a* of two rows. A locking portion 10 is provided at one side of a central portion of each of the connector portions 5 and 6. As shown in FIG. 2, a pitch A from a left end of the upper casing 1 to the left terminal holes 5*a*-1 of the left end connector portion 5 is different from a pitch A' from a right end of the upper casing 1 to the right terminal holes 5*a*-2 of the right end connector portion 5 due to provision of the locking portions 10. This difference between the pitches A and A' cannot be reduced to less than 1.3 mm. Meanwhile, a pitch B between the connector holes 5*a* of each connector portion 5 and a pitch C between neighboring ones of the connector portions 5** are fixed.

Therefore, in the connector portions 6 of the lower casing 2 which is coupled with the upper casing 1 by overturning the lower casing 2 upside down, a distance from a right end of the lower casing 2 to the right end terminal hole **6*a*-1 is equal to the pitch A, while a distance from a left end of the lower casing 2 to the left end terminal hole 6*a*-2 is equal to the pitch A'. Therefore, the terminal holes 5*a* and 6*a* of the upper and lower casings 1 and 2, which confront each other, deviate from each other through a distance of 1.3 mm (=A–A'). As a result, the bus bars 4 are formed such that the terminal portions 4*b* and 4*c* deviate from each other through a gap H of 1.3 mm (=A–A') at each of the coupling portions 4*a***.

The bus bars are formed by punching an electrically conductive metal plate with a press and bending the metal plate. In case a number of the bus bars of identical shape are required, the metal plate is continuously conveyed so as to be sequentially subjected to pressing. If layout of the bus bars 4 is performed as shown in FIG. 4, the bus bar blank is taken most efficiently from the metal plate when the terminal portions **4*b* and 4*c* projecting towards the upper and lower casings 1 and 2, respectively deviate from each other through the gap H. Namely, in regions S into which the terminal portions 4*b* and 4*c* of the bus bars 4 do not project, terminal portions 4*b*' and 4*c*' of neighboring bus bars 4' are arranged so as to deviate from the terminal portions 4*b* and 4*c*. Meanwhile, in FIG. 4**, two-dot chain lines indicate bent portions.

However, in continuous press working of sequential feed, since the same punching operation and the same bending operation should be performed on an identical line in the direction of the arrow R for transporting the bus bar blank, the bus bar blank cannot be taken from the metal plate by layout of FIG. 4.

On the other hand, in case the terminal portions **4*b*' and 4*c*' of the neighboring bus bars 4', which are arranged in the regions S so as to deviate from the terminal portions 4*b* and 4*c* of the bus bars 4, are eliminated as shown in FIG. 5, continuous press working of sequential feed can be performed. However, in this case, a number of the regions S become useless, thereby resulting in rise of cost of the bus bar blank. Furthermore, in this case, in order to cut off a plurality of bus bars from the bus bar blank subjected to the continuous working, a clearance C acting as a cutting allowance is required to be provided between neighboring ones of the bus bars 4**, thus resulting in further deterioration of yield of the bus bar blank.

SUMMARY OF THE INVENTION

Accordingly, an essential object of the present invention is to provide, with a view to eliminating the above mentioned drawbacks of prior art branch joint boxes, a branch joint box in which a casing assembly is formed by upper and lower casings of an identical shape by overturning one of the upper and lower casings and pitches of terminal holes of connector portions of the upper and lower casings are provided symmetrically such that upper and lower terminal portions of each of the bus bars can be formed symmetrically. Therefore, the bus bars can be formed by continuous press working of sequential feed without waste of a bus bar blank.

In order to accomplish this object of the present invention, a branch joint box according to the present invention comprises: upper and lower casings which have an identical shape and form a casing assembly by overturning one of the upper and lower casings upside down; the upper and lower casings being, respectively, provided with first connector portions and second connector portions which are arranged in a plurality of rows and have first terminal holes and second terminal holes, respectively; and bus bars each of which has a coupling portion and first and second terminal portions extending from opposite sides of the coupling portion, respectively such that the coupling portion is accommodated in the casing assembly; the first and second terminal portions being projected out of the first and second terminal holes, respectively; the upper casing having first locking portions disposed at one side of the first connector portions, respectively, while the lower casing has second locking portions engageable with the first locking portions and disposed at one side of the second connector portions, respectively; wherein the first and second terminal holes of the upper and lower casings are disposed symmetrically and the first and second terminal portions extend from the opposite sides of the coupling portion symmetrically in alignment with each other so as to be inserted through the first and second terminal holes, respectively.

More specifically, in the first and second connector portions of the upper and lower casings, the first and second locking portions disposed at one side of the first and second connector portions make a distance from one side face of each of the upper and lower casings to a corresponding outermost one of the first and second terminal holes and a distance from the other side face of each of the upper and lower casings to a corresponding outermost one of the first and second terminal holes different from each other. By this difference of the above distances, a protrusion is formed on one outer side face of each of the upper and lower casings adjacent to the other side of each of the first and second connector portions. Therefore, a pitch from a distal end of the protrusion to the corresponding outermost one of the first and second terminal holes coincides with a pitch from the other outer side face of each of the upper and lower casings to the corresponding outermost one of the first and second terminal holes. Accordingly, when the upper and lower casing have been coupled with each other by overturning one of the upper and lower casings upside down, the first and second terminal holes of the upper and lower casings are disposed symmetrically in alignment with each other.

Furthermore, the present invention provides a bus bar blank for forming the bus bars accommodated in the branch joint box. Namely, the bus bar blank comprises: a plurality of bus bars which are arranged in a plurality of rows in a longitudinal direction of the bus bar blank and in each of which a plurality of pairs of first and second terminal portions extend longitudinally symmetrically in opposite directions from a laterally extending coupling portion, respectively at a predetermined lateral interval; first and second carrier portions which are, respectively, coupled with opposite lateral sides of the coupling portion of each of the bus bars; wherein the first and second terminal portions of the bus bars of even rows are projected into regions into which the first and second terminal portions of the bus bars of odd rows are not projected; wherein the first and second terminal portions of the bus bars of odd rows are aligned with each other and the first and second terminal portions of the bus bars of even rows are aligned with each other such that the bus bar blank can be subjected to continuous press working of sequential feed.

In the bus bar blank referred to above, the width of each of the first and second carrier portions is increased such that a cutting line for separating each of the bus bars from the bus bar blank in each of the first and second carrier portions is set in hooked manner from a rear end position of the coupling portion of a front one of neighboring bus bars to a front end position of the coupling portion of a rear one of the neighboring bus bars such that cut distal ends of each of the first and second carrier portions project beyond the first and terminal portions of the neighboring bus bars.

In the branch joint box of the present invention including the upper and lower casings having an identical shape, the bus bars are initially mounted in the lower casing in parallel such that the second terminal portions of the bus bars are projected out of the second terminal holes of the lower casing, respectively. At this time, the upper casing is overturned upside down so as to be mounted on the lower casing such that the first terminal portions of the bus bars are projected out of the first terminal holes of the upper casing, respectively. As a result, the coupling portions of the bus bars are accommodated between the upper and lower casings. In this state, the first and second locking portions provided on the upper and lower casings are brought into engagement with each other.

In this branch joint box in which the upper and lower casings are coupled with each other, since the opposite outermost terminal holes are disposed symmetrically, the first and second terminal portions projecting from the opposite sides of the coupling portion of each of the bus bars symmetrically in alignment with each other can be mounted on the upper and lower casings.

In the bus bars mounted on the branch joint box, since the terminal portions can be symmetrically projected from the opposite sides of the coupling portion of each of the bus bars in alignment with each other. Therefore, since the bus bar blank for forming the bus bars enables continuous press working of sequential feed, the bus bars can be arranged at high yield in the bus bar blank.

Namely, in the bus bar blank in which the bus bars are arranged in a plurality of rows in the longitudinal direction, since the terminal portions of the bus bars of even rows are projected into the regions into which the terminal portions of the bus bars of odd rows are not projected, waste of material can be eliminated. In addition, since the terminal portions of the bus bars of odd rows can be aligned with each other and the terminal portions of the bus bars of even rows can be aligned with each other, the bus bar blank can be subjected to continuous press working of sequential feed.

Meanwhile, if the carrier portions disposed at the opposite sides of the bus bar blank are cut in a hooked manner from the rear end portion of the coupling portion of the front one of the neighboring bus bars to the front end position of the coupling portion of the rear one of the neighboring bus bars when the bus bars are separated from the bus bar blank subjected to continuous press working of sequential feed, the cut distal ends of each of the carrier portions can be projected beyond the first and second terminal portions of the neighboring bus bars and thus, the first and second terminal portions can be protected by projecting the carrier portions.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
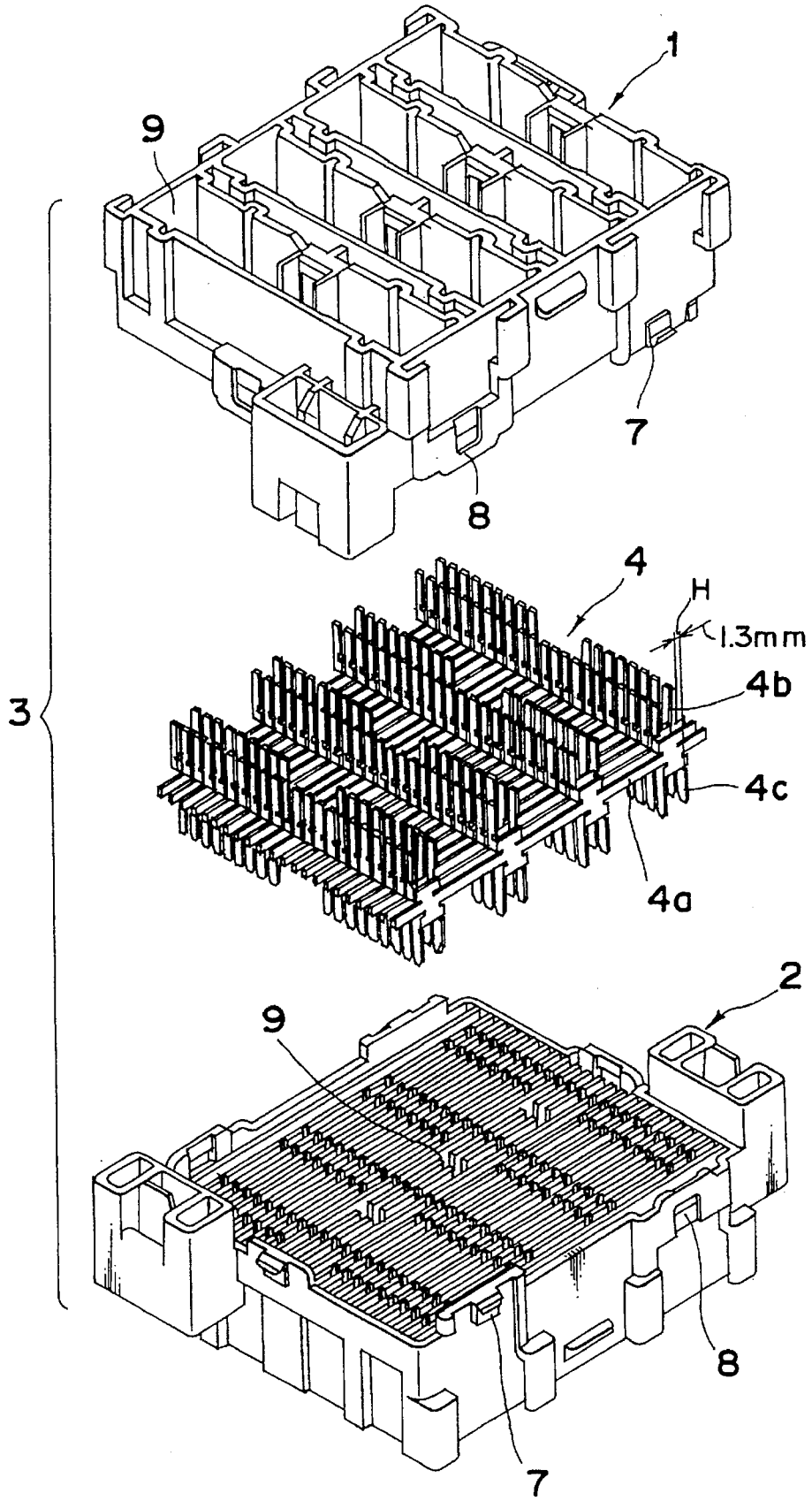
Fig. 1 PRIOR ART
FIG. 1 is an exploded perspective view of a prior art branch joint box (already referred to)
Figure 2:
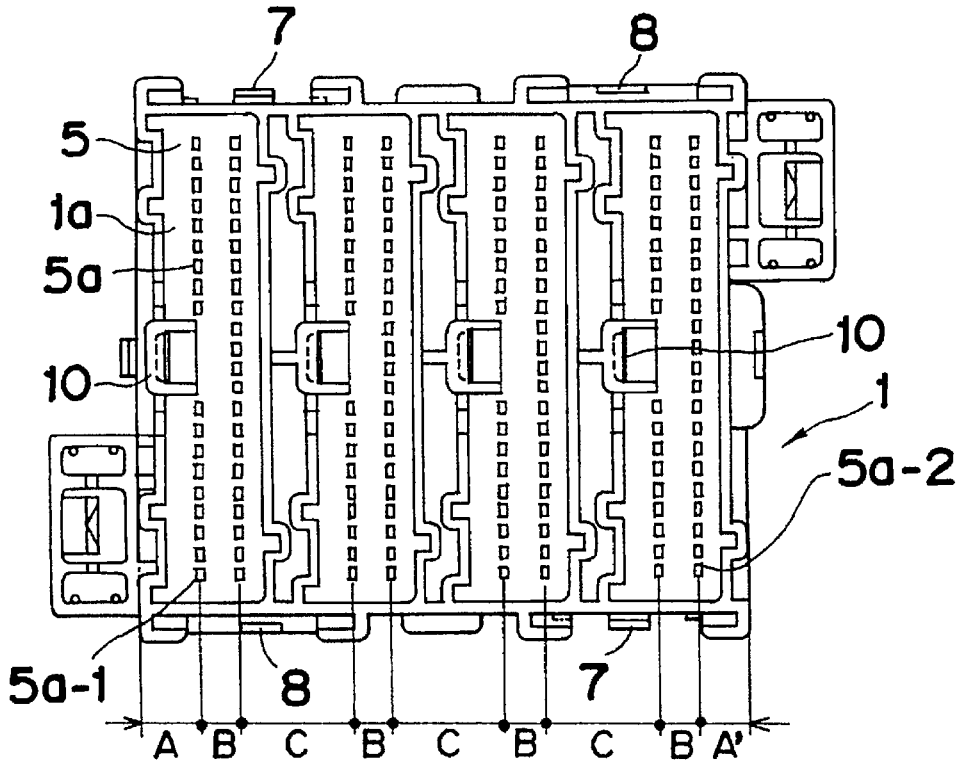
Fig. 2 PRIOR ART
FIG. 2 is a top plan view of an upper casing of the prior art branch joint box of FIG. 1 (already referred to)
Figure 3:
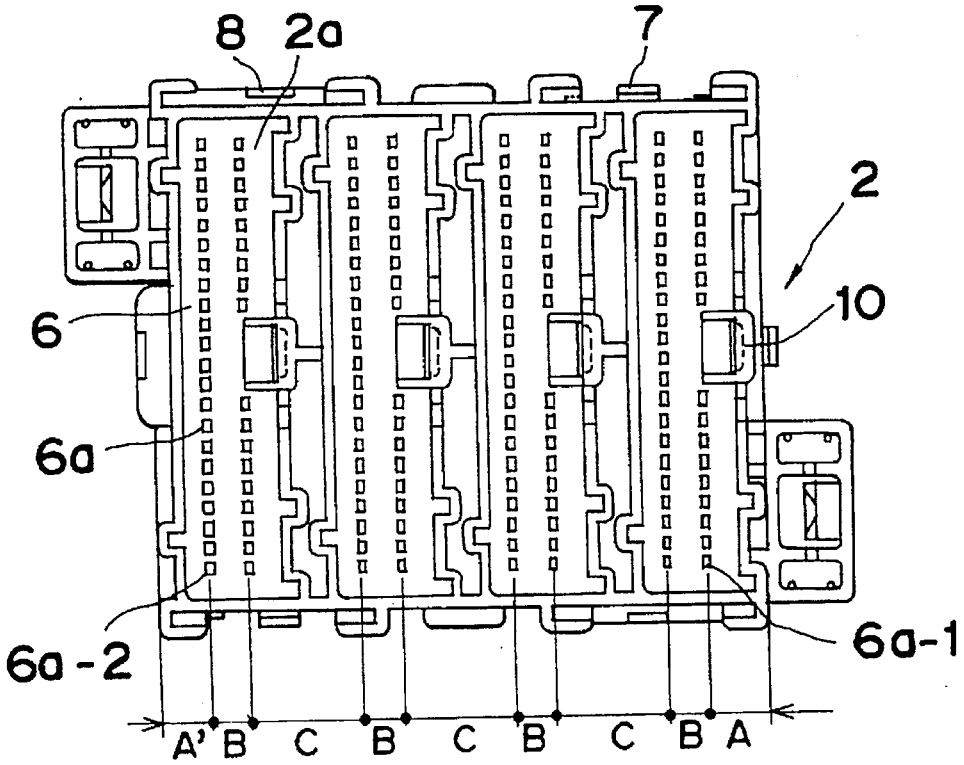
Fig. 3 PRIOR ART
FIG. 3 is a bottom plan view of a lower casing of the prior art branch joint box of FIG. 1 (already referred to)
Figure 4:
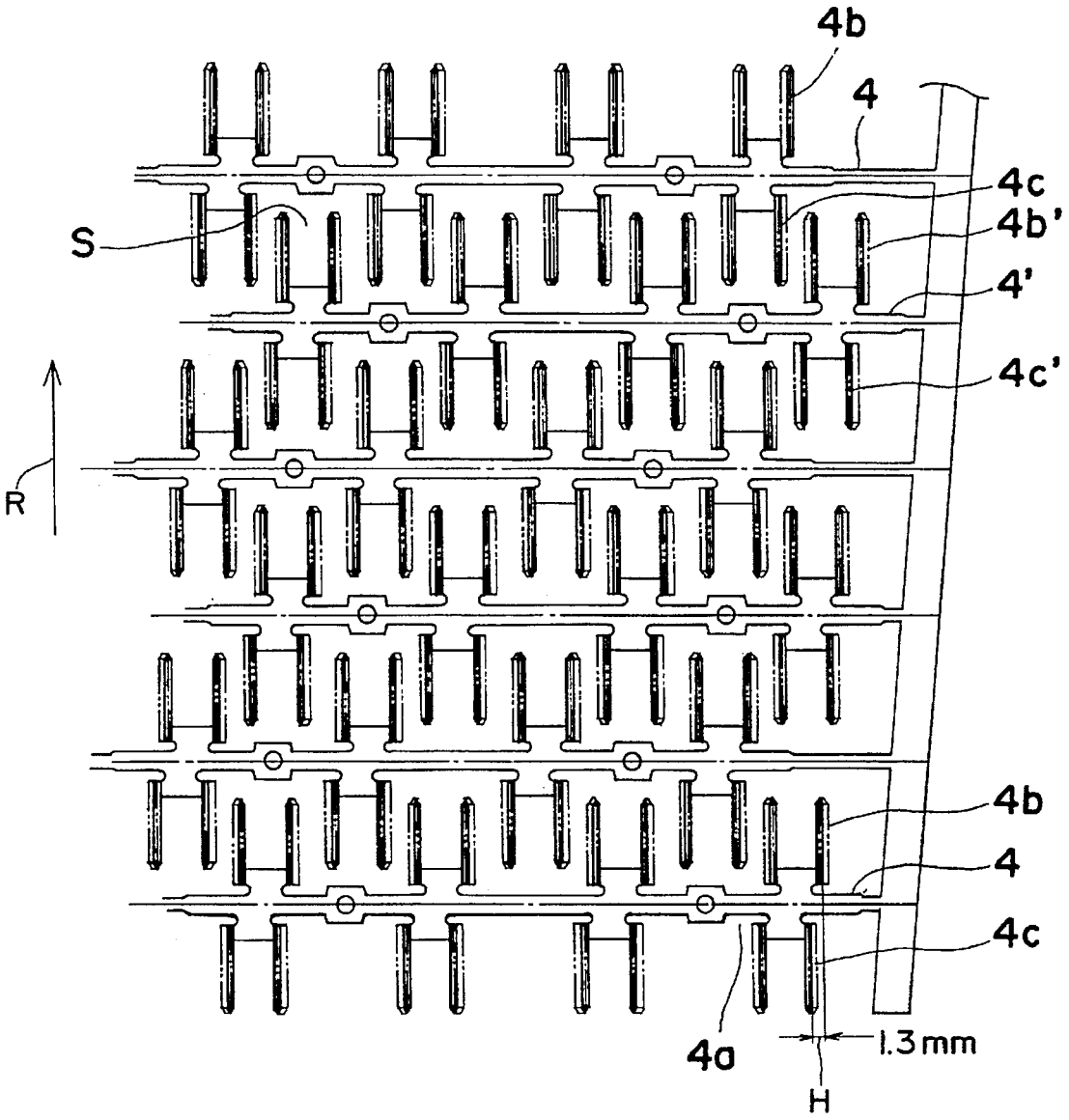
Fig. 4 PRIOR ART
FIG. 4 is a top plan view of a bus bar blank employed in the prior art branch joint box of FIG. 1 (already referred to)
Figure 5:
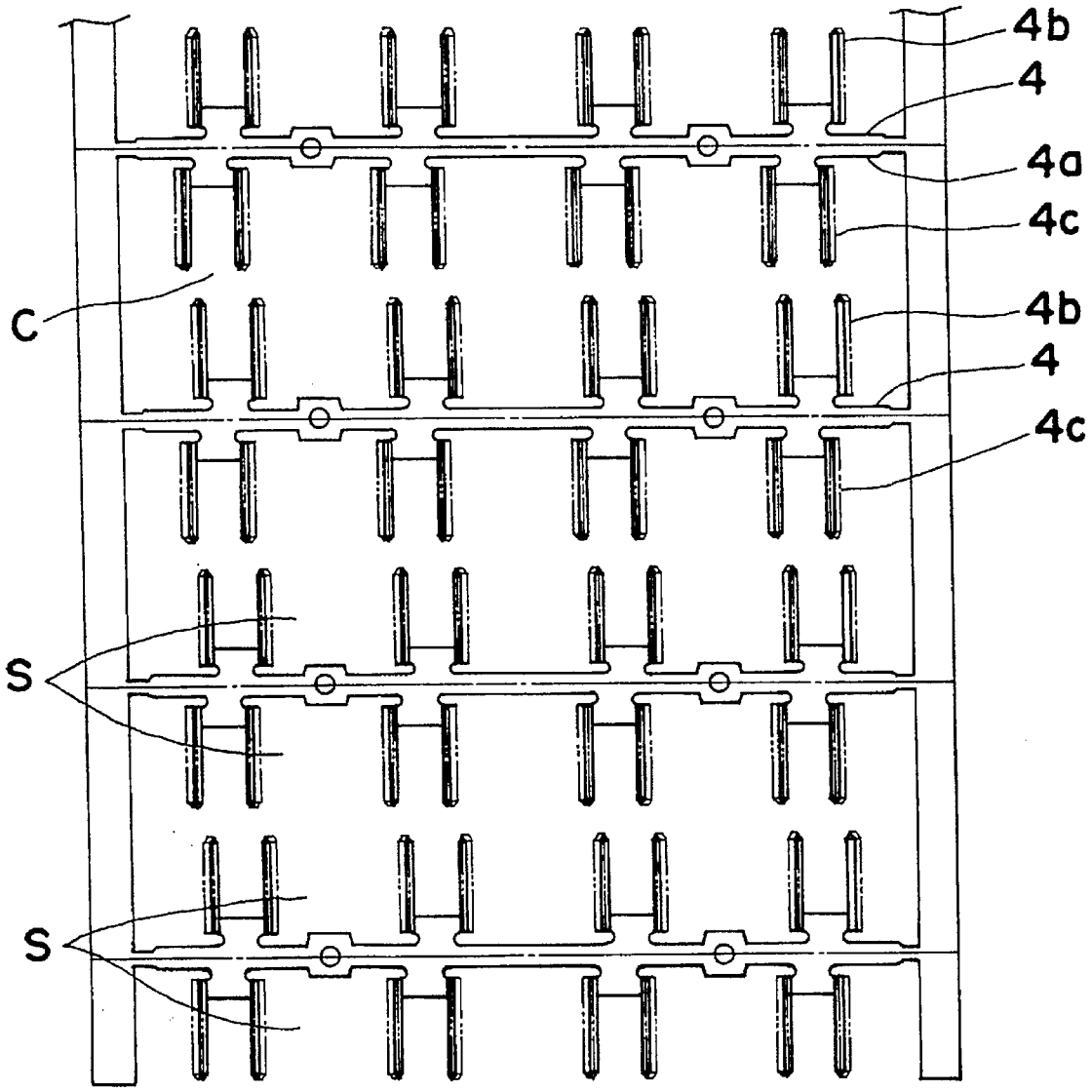
Fig. 5 PRIOR ART
FIG. 5 is a top plan view of another bus bar blank employed in the prior art branch joint box of FIG. 1 (already referred to)
Figure 6:
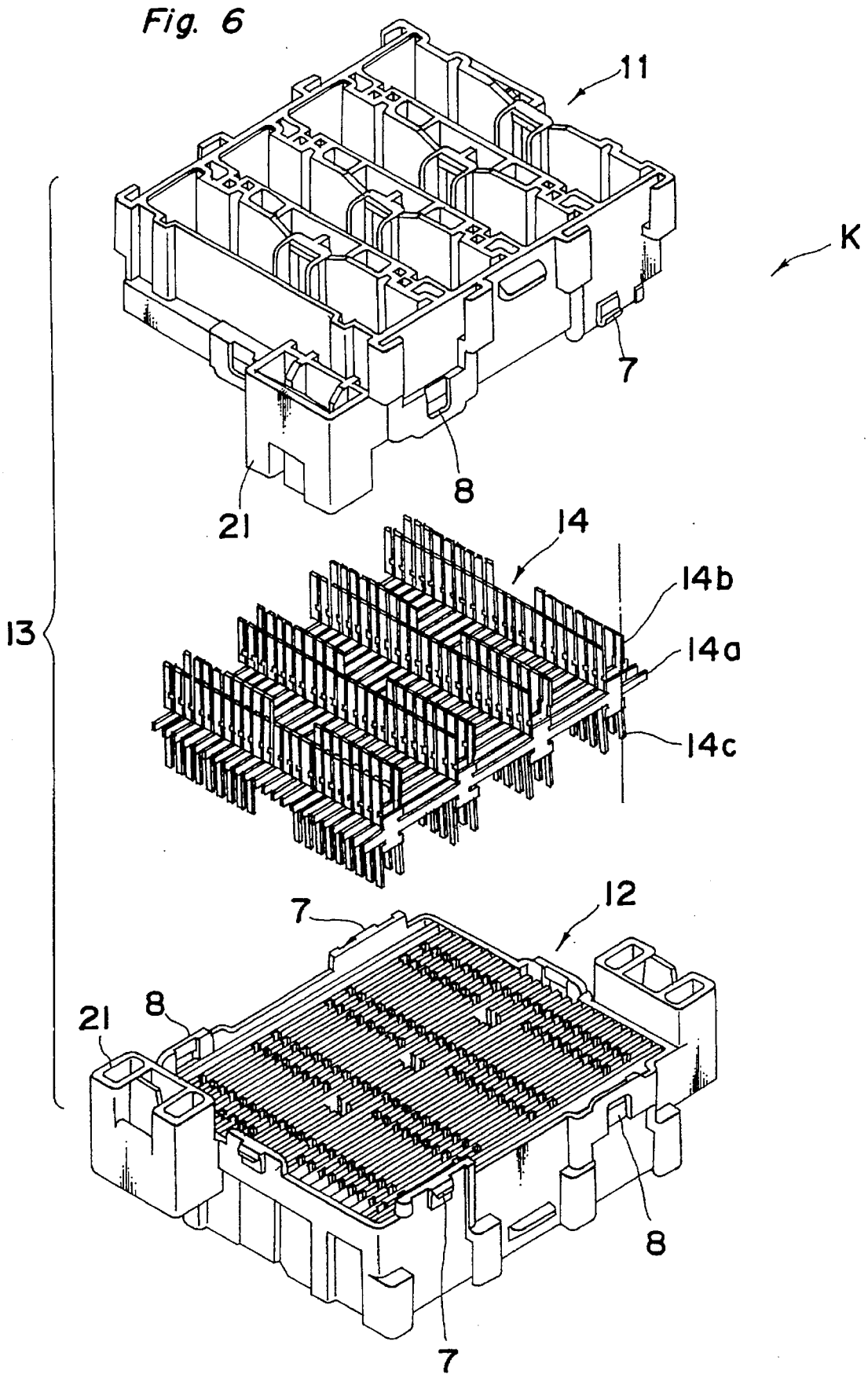
FIG. 6 is an exploded perspective view of a branch joint box according to the present invention.
Figure 7:
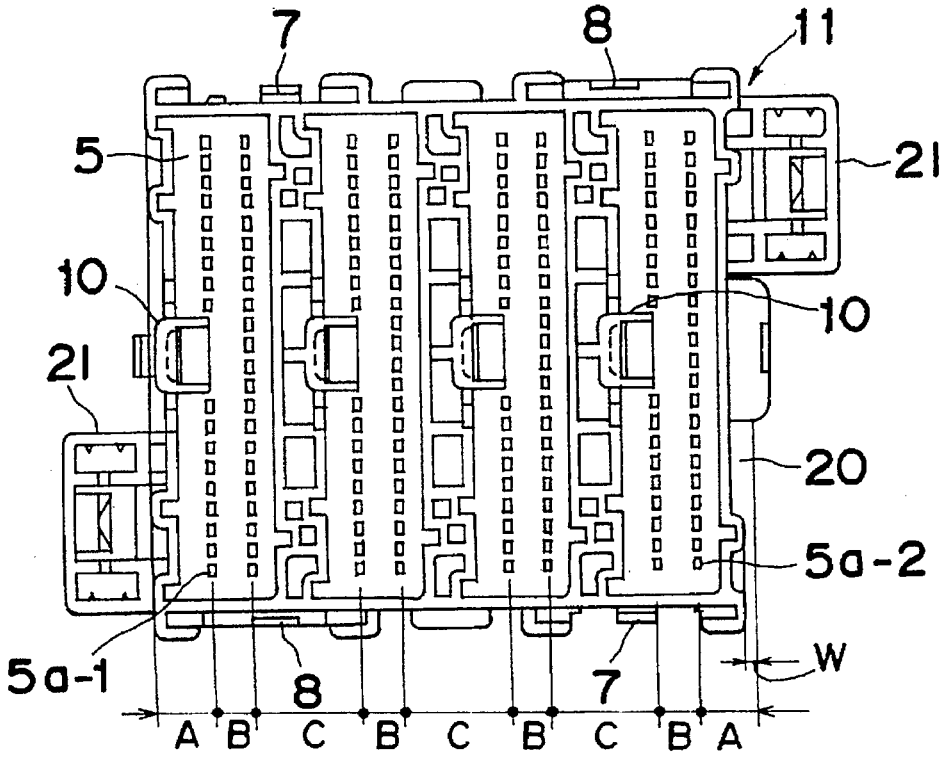
FIG. 7 is a top plan view of an upper casing of the branch joint box of FIG. 6.
Figure 8:
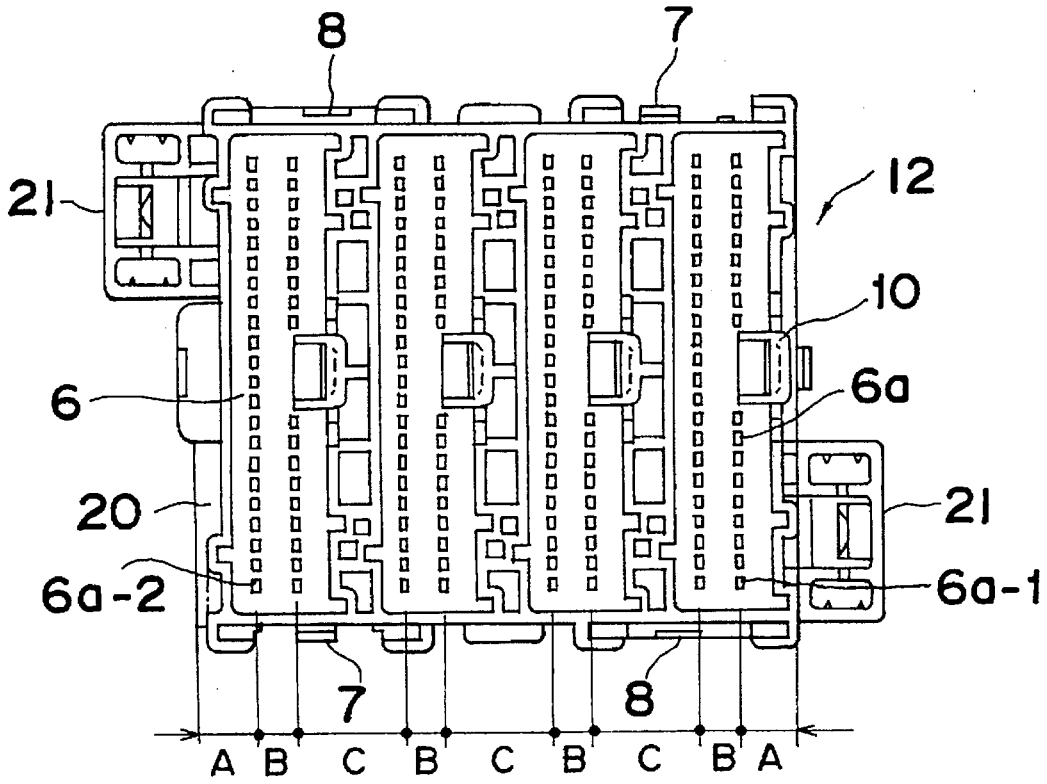
FIG. 8 is a bottom plan view of a lower casing of the branch joint box of FIG. 6.

Referring now to the drawings, there is shown in FIGS. 6 to 8, a branch joint box K according to one embodiment of the present invention. The branch joint box K includes upper and lower casings 11 and 12 of identical shape. The branch joint box K is different from a prior art branch joint box of FIGS. 1 to 3 only in that a protrusion 20 is provided on one side wall of each of the upper and lower casings 11 and 12 in the branch joint box K. Since other constructions of the branch joint box are similar to those of the prior art branch joint box, the detailed description is abbreviated for the sake of brevity. Namely, male and female locks 7 and 8 are provided on each of opposite side faces of the upper and lower casings 11 and 12 such that the male and female locks 7 and 8 on one of the opposite faces of each of the upper and lower casings 11 and 12 are, respectively, disposed diagonally relative to those on the other of the opposite faces of each of the upper and lower casings 11 and 12 as shown in FIG. 6. On one face of a partition wall of each of the upper and lower casings 11 and 12, which is oriented outwardly at the time of coupling of the upper and lower casings 11 and 12, connector portions 5 and 6 are laterally arranged in a plurality of rows, for example, four rows shown in FIG. 6. Each of the connector portions 5 has terminal holes 5*a* of two rows, while each of the connector portions 6 has terminal holes 6*a* of two rows. Meanwhile, in FIG. 6, reference numeral 21 denotes an engageable portion for mounting the branch joint box K on, for example, a body of a motor vehicle.

A locking portion 10 is provided at one side of each of the connector portions 5 and 6, i.e., at a left side of each of the connector portions 5 of the upper casing 11 and at a right side of each of the connector portions 6 of the lower casing 12 so as to be fitted into a mating connector. The protrusion 20 is provided on a right side wall of the upper casing 11 and on a left side wall of the lower casing 12.

In the upper casing 11, a projecting distance W of the protrusion 20 is set such that when a pitch from a left end of the upper casing 11 to the left end terminal hole 5*a*-1 is a distance A, a pitch from a right end of the upper casing 11 to the right end terminal hole 5*a*-2 is also the distance A. Therefore, also in the lower casing 12 which is overturned upside down relative to the upper casing 11, a pitch from a left end of the lower casing 12, which is provided with the protrusion 20, to the left end terminal hole 6*a*-2 is equal to the distance A and a pitch from a right end of the lower casing 12 to the right end terminal hole 6*a*-1 is equal to the distance A. As a result, the terminal holes 5*a* and 6*a* of the connector portions 5 and 6 disposed at upper and lower portions of a casing 13 in which the upper and lower casings 11 and 12 are coupled with each other can be aligned with each other symmetrically. As shown in FIG. 6, a plurality of bus bars 14 each having terminal portions 14*b* and 14*c* extending upwardly and downwardly in alignment with each other from a coupling portion 14*a* can be mounted in the casing 13 in which the upper and lower casings 11 and 12 are coupled with each other.

The branch joint box K is assembled as follows. Initially, the bus bars 14 are mounted in the lower casing 12 in parallel such that the downwardly extending terminal portions 14*c* of the bus bars 14 are projected out of the terminal holes 6*a* of the connector portions 6 arranged in a plurality of rows. In this state, the upper casing 11 is overturned upside down and is brought into engagement with the lower casing 12. Thus, the upwardly extending terminal portions 14*b* of the bus bars 14 are projected out of the terminal holes 5*a* of the connector portions 5 formed in the upper casing 11 such that the coupling portions 14*a* of the bus bars 14 are accommodated between the upper and lower casings 11 and 12. In this state, the male and female locks 7 and 8 provided on the upper casing 11 are, respectively, brought into engagement with the female and male locks 8 and 7 provided on the lower casing 12.

Figure 9:
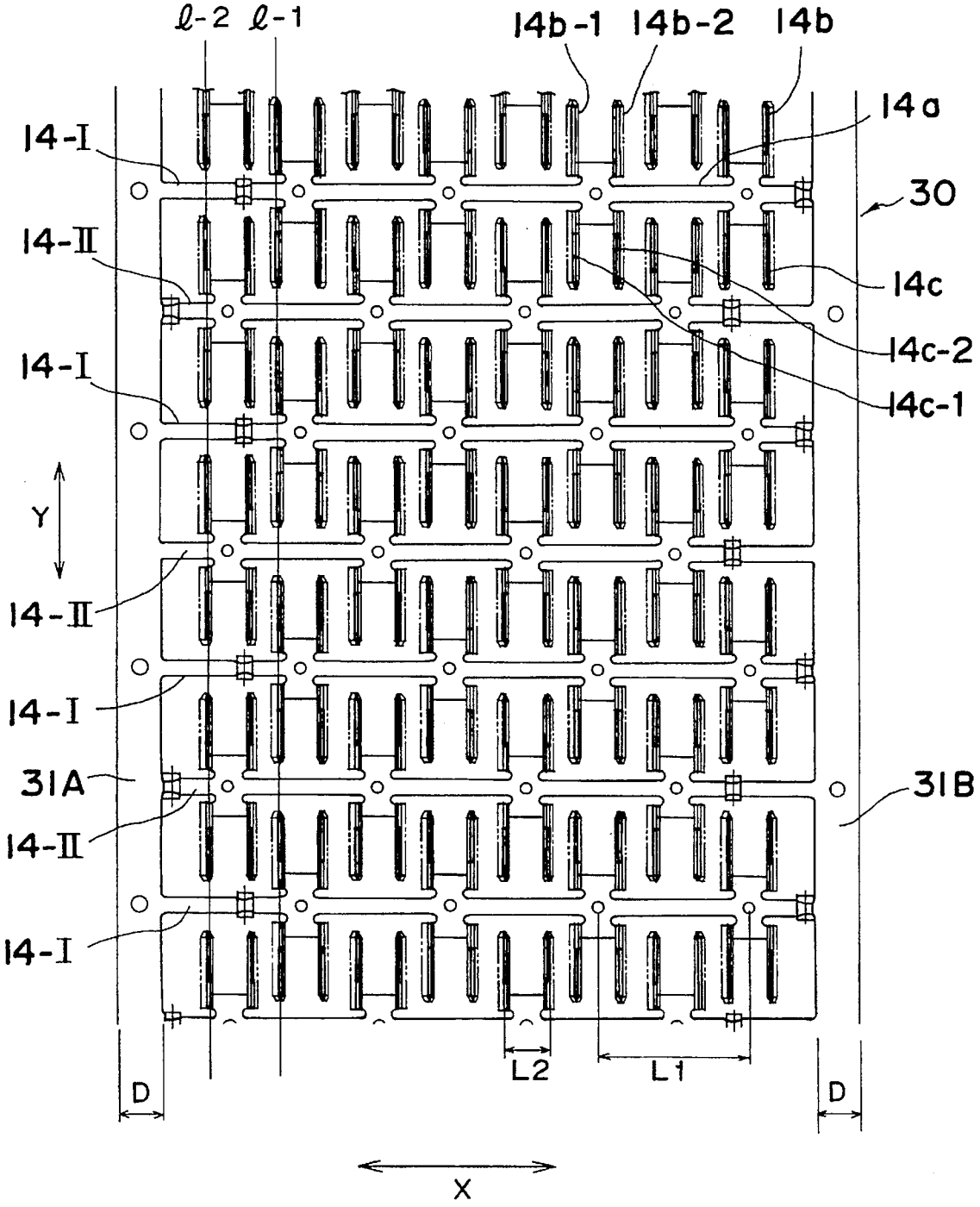
FIG. 9 is a top plan view of a bus bar blank for bus bars employed in the branch joint box of FIG. 6.

The bus bars 14 are cut off from a bus bar blank 30 shown in FIG. 9. At each of the bus bars 14, terminal portions 14*b*-1 and 14*b*-2 are spaced laterally an interval L1 from each other and terminal portions 14*c*-1 and 14*c*-2 are also spaced laterally the interval L1 from each other. The terminal portions 14*b*-1 and 14*c*-1 and the terminal portions 14*b*-2 and 14*c*-2 extend in the opposite longitudinal directions of the arrow Y in alignment with each other from opposite ends of the coupling portion 14*a* extending in the lateral directions of the arrow X. A pitch L2 between the terminal portions 14*b*-1 and 14*b*-2, i.e., between the terminal portions 14*c*-1 and 14*c*-2 is equal to a pitch B between the terminal holes 5*a* of each of the connector portions 5 and between the terminal holes 6*a* of each of the connector portions 6.

As shown in FIG. 9, the bus bar blank 30 has a plurality of rows of the bus bars 14 in the longitudinal direction of the arrow Y. Opposite ends of the coupling portion 14*a* of each bus bar 14 are, respectively, coupled with carrier portions 31A and 31B each having a width D. In the bus bars 14 arranged in a plurality of rows, the terminal portions of bus bars 14-II of even rows are projected into regions into which the terminal portions of bus bars 14-I of odd rows are not projected. Furthermore, the terminal portions of the bus bars 14-I of odd rows are aligned with a longitudinal line l-1, while the terminal portions of the bus bars 14-II of even rows are aligned with a longitudinal line l-2.

The terminal portions of the bus bars 14-I and 14-II are aligned with the longitudinal lines l-1 and l-2, respectively as described above. Therefore, by punching and bending the electrically conductive material for the bus bar blank with a press of sequential feed while the electrically conductive material is being transported continuously in the longitudinal directions of the arrow Y, it becomes possible to continuously form the terminal portions.

Figure 10:
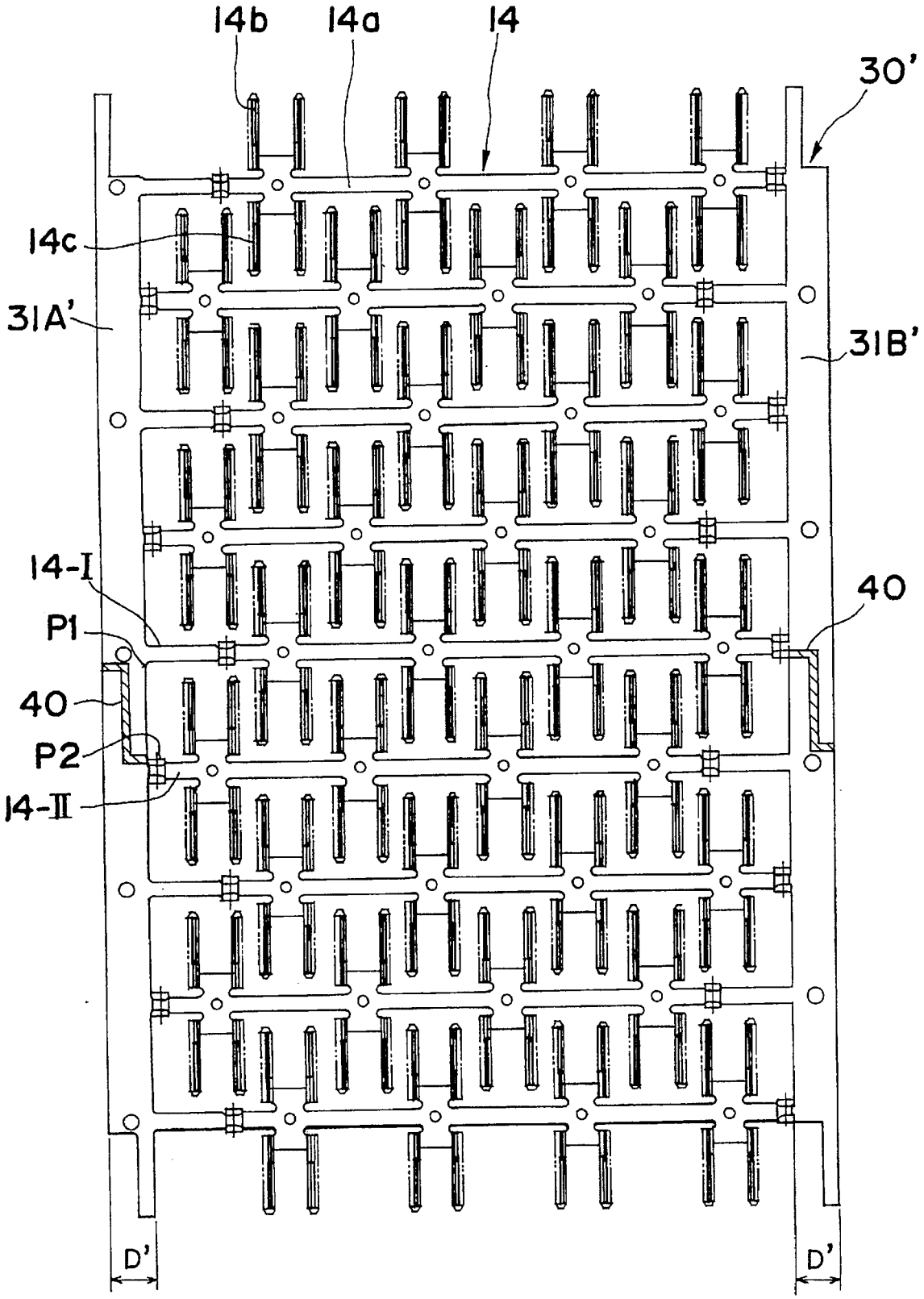
FIG. 10 is a view similar to FIG. 9, particularly showing its modification.

FIG. 10 shows a bus bar blank 30' which is a modification of the bus bar blank 30 of FIG. 9. In the bus bar blank 30', each of carrier portions 31A' and 31B' disposed at opposite ends of the coupling portion 14*a* has a width D' larger than the width D of each of the carrier portions 31A and 31B. In the bus bars 14 of neighboring ones of a plurality of rows when the carrier portions 31A' and 31B' are made wider as described above, the carrier portions 31A' and 31B' can be cut in hooked manner along cutting lines 40 from a rear end position P1 of the coupling portion 14*a* of the bus bar 14-I of the upstream row to a front end position P2 of the coupling portion 14*a* of the bus bar 14-II of the downstream row as shown in FIG. 10. When a bus bar set having an arbitrary number of the bus bars 14 is obtained from the bus bar blank 30' by cutting the carrier portions 31A' and 31B', a cut end of each of the carrier portions 31A' and 31B' projects beyond a distal end of each of the terminal portions 14*b* and 14*c* at all times and thus, the projecting terminal portions 14*b* and 14*c* of the bus bars 14 can be protected.

As is clear from the foregoing description of the branch joint box of the present invention, since the terminal holes of the connector portions provided on the upper and lower casings are disposed symmetrically in the casing assembly in which one of the upper and lower casings of identical shape is overturned upside down, the terminal portions extending in alignment with each other symmetrically from the opposite sides of each of the coupling portions of the bus bars can be fitted into the terminal holes. Therefore, since the terminal portions can be extended in alignment with each other symmetrically from the opposite sides of each of the coupling portions in the bus bars employed in the branch joint box, the bus bar can be obtained at high yield from the bus bar blank for the bus bars through continuous press working of sequential feed. Namely, in the bus bars of neighboring ones of a plurality of rows, the terminal portions of the bus bars of one of the neighboring rows are projected into the region into which the terminal portions of the bus bars of the other of the neighboring rows are not projected, thereby resulting in reduction of waste of material of the bus bar blank. Furthermore, since the terminal portions of odd and even rows in the bus bar blank can be aligned with the first and second longitudinal lines, respectively, the bus bar blank can be subjected to continuous press working of sequential feed.

Meanwhile, when the bus bars are separated from the bus bar blank by cutting the bus bar blank after continuous press working of sequential feed referred to above, the carrier portions disposed at the opposite sides of the bus bar blank in the bus bars of neighboring ones of a plurality of rows can be cut in hooked manner from the rear end position of the coupling portion of the bus bar of the upstream row to the front end position of the coupling portion of the bus bar of the downstream row. As a result, the distal end of each of the carrier portions can be projected beyond the terminal portions of the bus bars after cutting and thus, the terminal portions can be protected by the projecting carrier portions.

What is claimed is:

1. A bus bar blank comprising:

a plurality of bus bars which are arranged in a plurality of rows in a longitudinal direction of the bus bar blank, a plurality of pairs of first and second terminal portions in each bus bar extending longitudinally symmetrically in opposite directions from a laterally extending coupling portion, respectively, at a predetermined lateral interval;

first and second carrier portions which are, respectively, coupled with opposite lateral sides of the coupling portion of each of the bus bars;

wherein first and second terminal portions of the bus bars of even rows project into regions into which first and second terminal portions of the bus bars of odd rows do not project;

wherein the first and second terminal portions of the bus bars of odd rows are aligned with each other and the first and second terminal portions of the bus bars of even rows are aligned with each other such that the bus bar blank can be subjected to sequential feed during continuous process working.

2. A bus bar blank as claimed in claim 1, wherein a width of each of the first and second carrier portions is increased such that a cutting line for separating each of the bus bars from the bus bar blank in each of the first and second carrier portions is set in a shape of a hook from a rear end position of the coupling portion of a front one of neighboring bus bars to a front end portion of the coupling portion of a rear one of the neighboring bus bars, such that cut distal ends of each of the first and second carrier portions project beyond the first and second terminal portions of the neighboring bus bars.

* * * * *